US010286524B2

(12) United States Patent
Lu et al.

(10) Patent No.: US 10,286,524 B2
(45) Date of Patent: May 14, 2019

(54) ULTRAFINE ABRASIVE BIOPOLYMER SOFT POLISHING FILM AND MANUFACTURING METHOD THEREOF

(71) Applicant: HUAQIAO UNIVERSITY, Quanzhou (CN)

(72) Inventors: Jing Lu, Quanzhou (CN); Xipeng Xu, Quanzhou (CN); Hui Huang, Quanzhou (CN); Yunyun Song, Quanzhou (CN)

(73) Assignee: HUAQIAO UNIVERSITY, Quanzhou (CN)

( * ) Notice: Subject to any disclaimer, the term of this patent is extended or adjusted under 35 U.S.C. 154(b) by 228 days.

(21) Appl. No.: 15/312,957

(22) PCT Filed: May 19, 2015

(86) PCT No.: PCT/CN2015/079259

§ 371 (c)(1),
(2) Date: Nov. 21, 2016

(87) PCT Pub. No.: WO2015/176639

PCT Pub. Date: Nov. 26, 2015

(65) Prior Publication Data

US 2017/0136604 A1 May 18, 2017

(30) Foreign Application Priority Data

May 21, 2014 (CN) ..... 2014 1 0215615

(51) Int. Cl.

| | |
|---|---|
| ***B24D 3/00*** | (2006.01) |
| ***B24B 19/22*** | (2006.01) |
| ***B24B 37/22*** | (2012.01) |
| ***B24B 37/24*** | (2012.01) |
| ***B24D 11/00*** | (2006.01) |
| ***B24D 18/00*** | (2006.01) |

(52) U.S. Cl.

CPC ..... *B24D 11/00* (2013.01); *B24B 19/22* (2013.01); *B24B 37/22* (2013.01); *B24B 37/245* (2013.01); *B24D 3/00* (2013.01); *B24D 11/001* (2013.01); *B24D 18/0009* (2013.01)

(58) Field of Classification Search

None

See application file for complete search history.

(56) References Cited

U.S. PATENT DOCUMENTS

| | | | | |
|---|---|---|---|---|
| 2004/0003895 | A1* | 1/2004 | Amano | B24B 37/245 156/345.12 |
| 2004/0087250 | A1 | 5/2004 | Kramer et al. | |
| 2009/0041983 | A1 | 2/2009 | Gaeta et al. | |
| 2009/0215363 | A1* | 8/2009 | Sung | B24B 37/24 51/296 |
| 2011/0073800 | A1* | 3/2011 | Wang | C09G 1/04 252/79.1 |
| 2014/0242798 | A1* | 8/2014 | Izawa | C09K 3/1445 438/693 |

FOREIGN PATENT DOCUMENTS

| | | | |
|---|---|---|---|
| CN | 1376726 | A | 10/2002 |
| CN | 1464014 | A | 12/2003 |
| CN | 1843701 | A | 10/2006 |
| CN | 101733688 | A | 6/2010 |
| CN | 102046332 | A | 5/2011 |
| CN | 104002252 | A | 8/2014 |
| WO | WO-2004048473 | A1 | 6/2004 |

* cited by examiner

*Primary Examiner* — Kaj K Olsen
*Assistant Examiner* — Ross J Christie
(74) *Attorney, Agent, or Firm* — Rabin & Berdo, P.C.

(57) ABSTRACT

Disclosed is an ultrafine abrasive biopolymer soft polishing film having a base material, the base material including a high polymer base material formed by crosslinking, solidifying and drying a uniform mixture that include from 0.1-10 wt % of an ultrafine abrasive that is chemically coated with a coupling agent to provide a surface-modified ultrafine abrasive; from 5-15 wt % of a chemical additive for controlling dryness; and from 1-10 wt % of a biopolymer sol, wherein the coupling agent improves dispersion and holding of the surface-modified ultrafine abrasive in the high polymer base material, and a method of making the same.

17 Claims, No Drawings

ULTRAFINE ABRASIVE BIOPOLYMER SOFT POLISHING FILM AND MANUFACTURING METHOD THEREOF

TECHNICAL FIELD

The present invention relates to an ultraprecise polishing implement, particularly to a biopolymer soft polishing film containing ultrafine abrasives.

BACKGROUND

In recent years, fast development of the information and photoelectric technologies leads to increasingly high requirements for the manufacture of ceramic substrate, semiconductor wafer, optical crystal, decoration or construction stone. The manufacture of semiconductor wafer, in particular, requires ultra-smooth and ultra-flat surface, and the avoidance of residual stress and damage to the surface and subsurface.

The ultraprecise polishing methods for the above-described materials mainly include loose abrasive polishing, fixed abrasive polishing and non-traditional machining methods. During the loose abrasive polishing, the abrasive particles are arranged randomly and the track is uncontrolled. The abrasive particles form a three-body movement, resulting in low manufacturing efficiency. Aggregation may easily happen when the abrasive particles are small in size, which leads to workpiece surface damage and thus influencing the manufacturing quality. Corrosive grinding fluid and loose abrasive not only are wasteful, but also pollute the environment. Since the disk used in fixed abrasive polishing is rigid, and the recondition is complex during the polishing process, the conditions during manufacturing process must be strictly controlled to avoid damage easily caused to the workpiece. In addition, above mentioned aggregation problem also exists. Better surface quality may be obtained by other novel non-traditional manufacturing methods, however, the requirement for equipment is also high, and highly efficient and fast manufacturing of large workpieces is also difficult to be implemented. Therefore, these novel non-traditional manufacturing methods can hardly be applied in industry-wide mass manufacturing.

To solve the above-described problems, semi-fixed polishing means, such as ice disk, resin polishing plate, hydrophilic polishing film, have been developed by domestic and international researchers, which solve the dispersion issue of small particle abrasive to a certain degree. However, the holding force of the bond to the abrasive is relatively low and the abrasive is mostly loose during processing. Besides, the waste is quite trouble to treat post-processing as the polymer is rather difficult to be degraded.

SUMMARY

The object of the present invention is to overcome the problems of the existing ultraprecise polishing means and to provide an ultrafine abrasive polishing film based on degradable biopolymer material. The manufacturing method is simple, characterized by the green environmental protection and non-pollution. The shape and size of the film is unlimited, merely needs water to serve as polishing solution during ultraprecise non-damage manufacturing.

The technical proposal of the present invention is:

An ultrafine abrasive biopolymer soft polishing film having a base material, the base material comprising: 0.1-10 wt % of surface modified ultrafine abrasive, 5-15 wt % of chemical additive for controlling dryness and 1-10 wt % of biopolymer sol; the base material formed after mixing evenly and proportionally, physically or chemically cross-linking and solidifying, and drying;

the surface modification using a coupling agent to chemically coat the ultrafine abrasive to improve dispersion and holding of the ultrafine abrasive in the high polymer base material.

The coupling agent comprises at least one of silane coupling agent, titanate coupling agent and lignin coupling agent.

The ultrafine abrasive comprises at least one of diamond, carbide, boride and oxide, and the grain diameter of the ultrafine abrasive is in a range of 5 nm-40 μm.

The chemical additive for controlling dryness comprises a filler, a water carrying agent and a pore foaming agent, the filler comprises at least one of $SiO_2$ nanoparticle, $CaCO_3$ nanoparticle, polyimide nanoparticle and calcium magnesium nanoparticle powder; the water carrying agent comprises at least one of sucrose, lactose, fructose and glycerol; the pore foaming agent comprises at least one of $NaHCO_3$, NaCl, lauryl sodium sulfate, sodium dodecylbenzene sulfonate; a mixture ratio of the filler and the water carrying agent is in a range of 1-3 wt %:3-10 wt %, the added concentration of the pore foaming agent is adjusted according to a porosity requirement of the tool surface.

The biopolymer is at least one of starch, modified cellulose, chitosan, agarose, glucomannan, sodium alginate, gelatin, carrageenan, xanthan gum, pectin, galactomannan gum, polylactic acid.

The drying method can be constant temperature drying or infrared drying.

A manufacturing method of the ultrafine abrasive biopolymer soft polishing film comprising the steps:

(1) modification processing: modifying the ultrafine abrasive in an aqueous solution of the coupling agent;

(2) mixing the base material: mixing the modified ultrafine abrasive, the drying control chemical additive and the biopolymer sol evenly in a ratio of 0.1%~2%:4%~14%:1.5%~5%;

(3) molding and drying: spraying or spreading the mixed sol and solidifying after physically or chemically crosslinking, and then drying to form a polishing film.

In step (1), a weight ratio of the ultrafine abrasive and the coupling agent is in a range of 100:0.1-10.

The present invention has following advantages:

The ultrafine abrasive biopolymer soft polishing film of the present invention can be widely used in the manufacture of ceramic substrate, semiconductor wafer, optical crystal, decoration and construction stone, particularly in the processing of large size surfaces. The polishing film of the present invention has an ultrafine abrasive surface modified by a coupling agent, for efficiently solving the aggregation problem of the abrasive, and improving the holding force of the biopolymer base material to the inorganic abrasive. As the polishing film has improved softness, it can provide yielding effect to the abrasive, for avoiding the damage to the workpiece by the large hard particles when the fixed abrasive is used during the high efficiency manufacturing. Moreover, the polishing film of the present invention comprise chemical additive for controlling dryness, resulting in the polishing film having improved mechanical performance and lengthened storage life. The biopolymer material can be degraded by microbes, providing an environmental friendly polishing implement.

DETAILED DESCRIPTION OF THE EMBODIMENTS

Embodiment 1

The base material of the ultrafine abrasive biopolymer soft polishing film of the present invention may select:

Ultrafine abrasive: diamond;

Chemical additives for controlling dryness: including $SiO_2$ nanoparticles as a filler, sucrose as a water carrying agent, and sodium dodecyl sulfate (SDS) as a pore foaming agent;

Biopolymer base material: combination of starch and carrageenans;

Coupling agent: aqueous solution of KH-550 silane as a coupling agent.

The method for preparing the ultrafine abrasive biopolymer soft polishing film according to the present invention comprises the steps of:

(1) modification processing: diamond with particle size of 500 nm is added into aqueous solution of KH-550 silane coupling agent (the concentration of the coupling agent is 0.005%, the added amount of the diamond is 1%) and treated with ultrasound for 30 minutes;

(2) mixing the base material: the modified diamond powder (after the surface modification, the hydrolyzed functional group of the coupling agent is absorbed on the diamond, and diamond powder is obtained after filtration), $SiO_2$ with particle size of 30 nm, SDS, sucrose, carrageenan and starch are mechanically and thoroughly mixed in deionized water, the concentrations in weight percentage of them are 1%, 3%, 0.1%, 3%, 6%, 4%, respectively;

(3) molding and drying: the mixed sol is evenly distributed on a non-woven fabric surface by a coating machine, and an atomized sodium ion solution is sprayed on the mixed sol layer to form a gel; the gel is dried at a constant temperature and attached to a back glue layer to form a polishing film of the present invention.

The polishing film is placed on the polishing disk of an AUTOPOL-1000S automatic polishing machine. The rotational speed of the polishing disc was set at 120 rpm, the rotational speed of the sample carrying disk was set at 60 rpm, and the polishing pressure was set at 3 kg. A SiC wafer with an original roughness of 10 nm was polished for 2 h, the surface roughness reached 0.3 nm, and the wafer surface did not show any scratch or pit.

Embodiment 2

The base material of the ultrafine abrasive biopolymer soft polishing film of the present invention may select:

Ultrafine abrasive: aluminum oxide;

Chemical additives for controlling dryness: including $CaCO_3$ with grain diameter of 20 nm as a filler, glycerol as a water carrying agent, and NaCl grains as a pore foaming agent;

Biopolymer base material: combination of chitosan and sodium alginate;

Coupling agent: TTS titanate as a coupling agent;

The method for preparing the ultrafine abrasive biopolymer soft polishing film according to the present invention comprises the steps:

(1) modification processing: aluminum oxide with grain diameter of 10 μm is added to aqueous solution of TTS titanate coupling agent (the concentration of aluminum oxide and the TTS are 2%, 0.02%, respectively) at room temperature, and treated with ultrasound for 10 mins;

(2) mixing the base material: the modified aluminum oxide, $CaCO_3$ with grain diameter of 20 nm, NaCl, glycerol, chitosan and sodium alginate are mechanically and thoroughly mixed in deionized water, the concentrations in weight percentage of them are 2%, 1%, 0.2%, 3%, 3.5%, 5%, respectively;

(3) molding and drying: the mixed sol is coated to a circular spray-tin universal plate, and soaked in calcium ion solution to form a gel film. The gel film is infrared dried and is gently peeled off the universal plate, the smooth surface of the film is attached to a circular back adhesive to form polishing film of the present invention.

The polishing film is placed on the polishing disk of an AUTOPOL-1000S automatic polishing machine. The rotational speed of the polishing disk was set at 90 rpm, the rotation speed of the sample carrying disk was set at 80 rpm, the polishing pressure was 2 kg, a silicon wafer with an original roughness 500 nm was polished for 30 mins, the surface roughness reached 0.6 nm, and the wafer surface did not show any scratch or pit.

It should be noted that, the two above mentioned embodiments are merely used to describe the present invention in a non-limiting fashion, which may further include, but not limited to, following alternatives:

Crosslinking physically or chemically includes: molecular entanglement (gelatin, agarose) caused by temperature change; ion-crosslinking (sodium alginate, carrageenan, combination of sodium alginate and galactomannan gum, combination of carrageenan and xanthan gum); hydrogen bond or dewatering reaction (starch, modified cellulose, chitosan, glucomannan, and pectin); and crystallization (polylactic acid).

The coupling agent includes one or a combination of silane coupling agent (such as KH540, KH550, KH580), titanate coupling agent (such as KR-TTS, KP-TTS, KR-41B) and lignin coupling agent (such as high boiling alcohol solvent HBS).

The ultrafine abrasive comprises one or a combination of diamond, carbide (such as silicon carbide), boride (such as boron nitride) and oxide (such as aluminum oxide, silicon oxide, cerium oxide).

The grain diameter of the ultrafine abrasive may be in the range of 50 nm to 40 μm, and may also be 50 nm, 100 nm, 250 nm, 500 nm, 1 μm, 5 μm, 10 μm, etc.

The drying control chemical additive comprises filler, water carrying agent and pore foaming agent, the mixture ratio of the filler and the water carrying agent is in the range of 1-3 wt %:3-10 wt %. The concentration of the added pore foaming agent is regulated according to the requirement of the porosity of the tool surface, usually 0.1-2%, preferably 0.5-1.5%.

The filler includes one or a combination of $SiO_2$ nanoparticles, $CaCO_3$ nanoparticles, polyimide nanoparticles and calcium magnesium powder nanoparticles. The water carrying agent includes one or a combination of sucrose, lactose, fructose and glycerol. The pore foaming agent includes one or a combination of $NaHCO_3$, NaCl, lauryl sodium sulfate, sodium dodecylbenzene sulfonate.

The biopolymer base material includes one or a combination of starch, modified cellulose, chitosan, agarose, glucomannan, sodium alginate, gelatin, carrageenan, xanthan gum, pectin, galactomannan gum, and polylactic acid.

INDUSTRIAL APPLICABILITY

The ultrafine abrasive biopolymer soft polishing film has the ultrafine abrasive surface modified by a coupling agent, which can efficiently solve the aggregation problem of the abrasive and improve the holding force of the biopolymer base material to the inorganic abrasive. As the polishing film has improved softness, it can provide yielding effect to the abrasive, for avoiding the damage to the workpiece by the bigger hard particles when the fixed abrasive is used during the high efficiency manufacturing. The ultrafine abrasive biopolymer soft polishing film of the present invention can be widely used in ceramic substrate, semiconductor wafer, optical crystal, decoration and construction stone, particularly in ultraprecise manufacturing of large size surface.

The invention claimed is:

1. An ultrafine abrasive biopolymer soft polishing film having a base material, the base material comprising:

a high polymer base material formed by crosslinking, solidifying and drying a uniform mixture that comprises:

from 0.1-10 wt % of an ultrafine abrasive that is chemically coated with a coupling agent to provide a surface-modified ultrafine abrasive;

from 5-15 wt % of a chemical additive for controlling dryness; and from 1-10 wt % of a biopolymer sol, wherein the coupling agent improves dispersion and holding of the surface-modified ultrafine abrasive in the high polymer base material.

2. The ultrafine abrasive biopolymer soft polishing film according to claim 1, wherein the coupling agent comprises at least one coupling agent selected from the group consisting of a silane coupling agent, a titanate coupling agent, and a lignin coupling agent.

3. The ultrafine abrasive biopolymer soft polishing film according to claim 1, wherein the ultrafine abrasive comprises at least one abrasive selected from the group consisting of diamond powder, a carbide powder, a boride powder, and an oxide powder and has a grain diameter ranging from 5 nm-40 μm.

4. The ultrafine abrasive biopolymer soft polishing film according to claim 1, wherein the chemical additive for controlling dryness comprises:

(a) a filler that comprises at least one filler selected from the group consisting of $SiO_2$ nanoparticles, $CaCO_3$ nanoparticles, polyimide nanoparticles, and a calcium magnesium nanoparticle powder;

(b) a water carrying agent that comprises at least one water carrying agent selected from the group consisting of sucrose, lactose, fructose and glycerol; and (c) a pore foaming agent that comprises at least one pore foaming agent selected from the group consisting of $NaHCO_3$, NaCl, lauryl sodium sulfate, sodium dodecyl sulfate (SDS), and sodium dodecylbenzene sulfonate, wherein the filler and the water carrying agent have a mixture ratio ranging from 1 wt %:10 wt % to 3 wt %, and wherein a predetermined porosity is obtained by varying amount of the at least one pore foaming agent in the chemical additive for controlling dryness.

5. The ultrafine abrasive biopolymer soft polishing film according to claim 1, wherein the biopolymer sol comprises is at least one biopolymer selected from the group consisting of starch, modified cellulose, chitosan, agarose, glucomannan, sodium alginate, gelatin, carrageenan, xanthan gum, pectin, galactomannan gum, and polylactic acid.

6. A method for manufacturing ultrafine abrasive biopolymer soft polishing film according to claim 1, the method comprising:

(a) modifying the ultrafine abrasive in an aqueous solution of the coupling agent to chemically coat the ultrafine abrasive with the coupling agent and provide the surface-modified ultrafine abrasive;

(b) uniformly mixing from 0.1-10 wt % of the modified ultrafine abrasive, from 5-15 wt % of the chemical additive for controlling dryness, and from 1-10 wt % of the biopolymer sol to form the uniform mixture;

(c) crosslinking the uniform mixture;

(d) forming a layer of the uniform mixture after the crosslinking by coating the uniform mixture after crosslinking by spraying or spreading and solidifying, and (e) drying the layer to form the ultrafine abrasive biopolymer soft polishing film.

7. The method according to claim 6, wherein the ultrafine abrasive and the coupling agent are present in a weight ratio ranging from 100:0.1 to 100:10.

8. The method according to claim 6, wherein, in step (a), the ultrafine abrasive comprises diamond powder having a grain diameter of 500 nm and the coupling agent is a silane coupling agent and is a commercial material KH 550, and a modified diamond powder is provided, wherein, in step (b), the uniform mixture includes the modified diamond powder, the chemical additive for controlling dryness that includes: a filler that is $SiO_2$ having a particle size of 30 nm, a pore foaming agent that is sodium dodecyl sulfate (SDS), and a water carrying agent that is sucrose, and the biopolymer sol that includes carrageenan and starch, which are thoroughly mechanically mixed in deionized water, in weight percentage amounts of the diamond powder, the SiO2, the sodium dodecyl sulfate (SDS), the sucrose, the carrageenan, and the starch, which are, respectively, 1%, 3%, 0.1%, 3%, 6%, and 4%, wherein, in step (d), the uniform mixture after crosslinking is coated to be evenly distributed on a surface of a non-woven fabric as the layer by a coating machine, wherein, between steps (d) and (e), the method further comprises spraying on the layer an atomized sodium ion solution to form a gel and provide a gel layer, and wherein, in step (e), the gel layer is dried at a constant temperature to form the ultrafine abrasive biopolymer soft polishing film.

9. The method according to claim 8, wherein in step (a), the coupling agent is present in a concentration of 0.005%, and the diamond powder is present in an amount of 1%.

10. The method according to claim 6, wherein in step (a), the ultrafine abrasive comprises aluminum oxide powder having a grain diameter of 10 μm and the coupling agent is a titanate coupling agent (TTS), and the modifying includes treating the ultrafine abrasive in the aqueous solution of the coupling agent with ultrasound for 10 minutes to provide a modified aluminum oxide powder;

wherein, in step (b), the uniform mixture includes the modified aluminum oxide, the chemical additive for controlling dryness that includes a filler that is $CaCO_3$ having a grain diameter of 20 nm, a pore foaming agent that is NaCl, and a water carrying agent that is glycerol, and the biopolymer sol that includes chitosan and sodium alginate, which are thoroughly mechanically mixed in deionized water in weight percentage amounts of the aluminum oxide powder, the $CaCO_3$, the NaCl, the glycerol, the chitosan, and the sodium alginate, which are, respectively, 2%, 1%, 0.2%, 3%, 3.5%, and 5%, wherein, in step (d), the uniform mixture after crosslinking is coated onto a circular spray-tin universal plate as a layer, wherein, between steps (d) and (e), the method further comprises soaking the layer in a calcium ion solution to form a gel film, and wherein, in step (e), the gel film is infrared dried to form the ultrafine abrasive biopolymer soft polishing film.

11. The method according to claim 10, wherein in step (a), the aluminum oxide powder is present in a concentration of 2 wt %, and the titanate coupling agent (TTS) is present in a concentration of 2 wt %.

12. A method for manufacturing the ultrafine abrasive biopolymer soft polishing film according to claim 2, the method comprising:

(a) modifying the ultrafine abrasive in an aqueous solution of the coupling agent to chemically coat the ultrafine abrasive with the coupling agent and provide the surface-modified ultrafine abrasive;

(b) uniformly mixing from 0.1-10 wt % of the surface-modified ultrafine abrasive, from 5-15 wt % of the drying control chemical additive, and from 1-10 wt % of the biopolymer sol to form a uniform mixture;

(c) crosslinking the uniform mixture;

(d) forming a layer of the uniform mixture after the crosslinking by coating the uniform mixture after the crosslinking by spraying or spreading and solidifying; and (e) drying the layer to form the ultrafine abrasive biopolymer soft polishing film.

13. The method according to claim 12, wherein the ultrafine abrasive and the coupling agent are present in a weight ratio ranging from 100:0.1-10.

14. The method according to claim 12, wherein, in step (a), the ultrafine abrasive comprises diamond powder having a grain diameter 500 nm and the coupling agent is a silane coupling agent and is a commercial material KH 550, and a modified diamond powder is provided, wherein, in step (b), the uniform mixture includes the modified diamond powder, the chemical additive for controlling dryness that includes a filler that is $SiO_2$ having a particle size of 30 nm, a pore foaming agent that is sodium dodecyl sulfate (SDS), and a water carrying agent that is sucrose, and the biopolymer sol that includes carrageenan and starch, which are thoroughly mechanically mixed in deionized water, in weight percentage amounts of the diamond powder, the SiO2, the sodium dodecyl sulfate (SDS), the sucrose, the carrageenan, and the starch that are, respectively, 1%, 3%, 0.1%, 3%, 6%, and 4%, wherein, in step (d), the uniform mixture after crosslinking is coated to be evenly distributed on a surface of a non-woven fabric as the layer by a coating machine, wherein, between steps (d) and (e), the method further comprises spraying on the layer an atomized sodium ion solution to form a gel and provide a gel layer, and wherein, in step (e), the gel layer is dried at a constant temperature to form the ultrafine abrasive biopolymer soft polishing film.

15. The method according to claim 14, wherein in step (a), the coupling agent is present in a concentration of 0.005%, and the diamond powder is present in an amount of 1%.

16. The method according to claim 12, wherein in step (a), the ultrafine abrasive comprises aluminum oxide powder having a grain diameter of 10 μm and the coupling agent is a titanate coupling agent (TTS), and the modifying includes treating the ultrafine abrasive in the aqueous solution of the coupling agent with ultrasound for 10 minutes to provide a modified aluminum oxide powder;

wherein, in step (b), the modified aluminum oxide, the chemical additive for controlling dryness including a filler that is $CaCO_3$ having a grain diameter of 20 nm, a pore foaming agent that is NaCl, and a water carrying agent that is glycerol, and the biopolymer sol including chitosan and sodium alginate are mechanically and thoroughly mixed in deionized water in weight percentage amounts of the aluminum oxide powder, the $CaCO_3$, the NaCl, the glycerol, the chitosan, and the sodium alginate, which are, respectively, 2%, 1%, 0.2%, 3%, 3.5%, and 5%, wherein, in step (d), the uniform mixture after crosslinking is coated onto a circular spray-tin universal plate as a layer, wherein, between steps (d) and (e), the method further comprises soaking the layer in a calcium ion solution to form a gel film, and wherein, in step (e), the gel film is infrared dried to form the ultrafine abrasive biopolymer soft polishing film.

17. The method according to claim 16, wherein in step (a), the aluminum oxide powder is present in a concentration of 2 wt %, and the titanate coupling agent (TTS) is present in a concentration of 2 wt %.

* * * * *